US009583860B1

(12) United States Patent
DeWitte

(10) Patent No.: US 9,583,860 B1
(45) Date of Patent: Feb. 28, 2017

(54) ELECTRICAL CONNECTOR WITH RECORDABLE POSITION ASSURANCE

(71) Applicant: TYCO ELECTRONICS CORPORATION, Berwyn, PA (US)

(72) Inventor: Thomas Robert DeWitte, Shelby Township, MI (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 14/950,599

(22) Filed: Nov. 24, 2015

(51) Int. Cl.
*H01R 13/641* (2006.01)
*H01R 13/436* (2006.01)
*H01R 13/629* (2006.01)
*H01R 13/46* (2006.01)

(52) U.S. Cl.
CPC ..... *H01R 13/436* (2013.01); *H01R 13/465* (2013.01); *H01R 13/62933* (2013.01)

(58) Field of Classification Search
CPC ..... H01R 13/641; H01R 13/62933–13/62972
USPC ..... 439/489, 157, 159, 372
See application file for complete search history.

(56) References Cited

U.S. PATENT DOCUMENTS 5,376,017 A * 12/1994 Taniuchi ..... H01R 13/639 439/372
6,471,527 B2 * 10/2002 Fukamachi ..... H01R 13/62938 439/157
6,817,891 B2 * 11/2004 Wrede ..... G09F 3/00 439/491
6,863,551 B2 * 3/2005 Fukamachi ..... H01R 13/64 439/157
7,223,130 B2 * 5/2007 Osada ..... H01R 13/4362 439/157
7,329,132 B1 * 2/2008 Kamath ..... H01R 13/193 439/157
7,351,089 B2 * 4/2008 Neale, III ..... H01R 13/6277 439/352
7,381,084 B1 * 6/2008 Horn ..... H01R 13/6272 439/350
7,568,933 B2 * 8/2009 Shirai ..... H01R 13/641 439/271
2002/0182928 A1 * 12/2002 Matsushita ..... H01R 13/6295 439/489
2006/0276074 A1 * 12/2006 Boldy ..... H01R 13/465 439/491

(Continued)

*Primary Examiner* — Gary Paumen

(57) ABSTRACT

An electrical connector with recordable position assurance includes a housing, an electrical conductor, an indicating feature, and a concealing feature. The housing is configured to engage a complementary mating connector during a mating operation. The indicating feature and the concealing feature are both carried by the housing. The indicating feature has a visual identifier disposed thereon. The indicating feature and the concealing feature are movable relative to each other between a concealed position and an exposed position. The concealing feature conceals at least a portion of the visual identifier in the concealed position. The visual identifier is exposed or exposable in the exposed position. The indicating feature is in the exposed position relative to the concealing feature when the housing is fully mated to the mating connector, and is in the concealed position relative to the concealing feature when the housing and mating connector are not fully mated.

20 Claims, 7 Drawing Sheets

(56) References Cited

U.S. PATENT DOCUMENTS

2009/0104806 A1* 4/2009 Pellen ..... H01R 13/465
439/277
2015/0318640 A1 11/2015 Gibeau

* cited by examiner

ELECTRICAL CONNECTOR WITH RECORDABLE POSITION ASSURANCE

BACKGROUND OF THE INVENTION

The subject matter herein relates generally to electrical connector systems.

Some electrical connector systems and/or components thereof include a recordable feature that is used to record and log a presence, position, characteristic, or the like of the connector system during a manufacturing process or an assembly process. For example, a characteristic may be recorded that indicates whether a first connector is mated to a complementary second connector. It may be useful to record that the first and second connectors are mated to verify that such a connection has been made in the assembly process and/or to verify the presence of the first and second connectors in a larger product that is being assembled, such as an automobile or an appliance. Such data may be stored in a database.

One known mechanism for recording when a first connector is mated to a second connector utilizes fasteners that are configured to be torqued, such as screws or threaded bolts. The fasteners may connect the first connector to the second connector or to a structure on which the second connector is mounted. The connector system may be configured such that a fastener is only able to connect the first and second connectors when the first and second connectors are fully mated or at least close to being fully mated. The torque on the fastener can be a characteristic that is measured and recorded to indicate that the first and second connectors are mated. However, this known mechanism of recording torque on a fastener in order to indicate that a pair of connectors is mated has several disadvantages. For example, the fasteners may not be necessary components of the mating process between the first and second connectors, such that a primary use of the fasteners is as a recordable feature. But, using fasteners increases part costs, increases assembly steps and complexity of assembly, and also consumes valuable space along the connector system. For example, the connector system may be configured to be loaded into a narrow compartment. The fasteners may interfere with wiring or other components in the compartment, and/or there may not be sufficient clearance in the compartment for a tool that engages and actuates the fastener. Furthermore, a torque measurement is only specific to the fastener that is engaged, not to an electrical connector or connector system. Therefore, it is possible for a worker to erroneously or purposefully circumvent installing the fastener and recording the torque on the fastener to log that a first pair of connectors are mated by recording the torque on a different fastener between a different, second pair of connectors and associating that measurement with the first pair of connectors in a log or database.

A need remains for another mechanism for recording information about an electrical connector system or component thereof during a manufacturing or assembly process.

BRIEF DESCRIPTION OF THE INVENTION

In an embodiment, an electrical connector is provided that has recordable position assurance. The electrical connector includes a housing, at least one electrical conductor, an indicating feature, and a concealing feature. The housing has a mating interface configured to engage a complementary mating connector during a mating operation. The at least one electrical conductor is held in the housing. The at least one electrical conductor is configured to engage and electrically connect to one or more corresponding mating conductors of the mating connector. The indicating feature is carried by the housing. The indicating feature has a visual identifier disposed thereon. The concealing feature is carried by the housing. The indicating feature and the concealing feature are movable relative to each other between a concealed position and an exposed position. The concealing feature conceals at least a portion of the visual identifier in the concealed position. The visual identifier is at least one of exposed or exposable in the exposed position. The indicating feature is in the concealed position relative to the concealing feature when the housing is not fully mated relative to the mating connector. The indicating feature is in the exposed position relative to the concealing feature when the housing is fully mated to the mating connector.

In another embodiment, an electrical connector is provided that has recordable position assurance. The electrical connector includes a housing, at least one electrical conductor, an indicating feature, and a concealing feature. The housing has a mating interface configured to engage a complementary mating connector during a mating operation. The at least one electrical conductor is held in the housing. The at least one electrical conductor is configured to engage and electrically connect to one or more corresponding mating conductors of the mating connector. The indicating feature has a visual identifier disposed thereon. The visual identifier identifies the electrical connector. The indicating feature is at least one of a connector position assurance (CPA) element coupled to the housing, a wall of the housing, or a lever coupled to the housing. The concealing feature is at least one of the CPA element, the wall of the housing, or the lever. None of the CPA element, the wall of the housing, or the lever defines both the indicating feature and the concealing feature. The indicating feature and the concealing feature are movable relative to each other between a concealed position and an exposed position. The concealing feature conceals at least a portion of the visual identifier in the concealed position. The visual identifier is at least one of exposed or exposable in the exposed position. The indicating feature is in the concealed position relative to the concealing feature when the housing is not fully mated relative to the mating connector. The indicating feature is in the exposed position relative to the concealing feature when the housing is fully mated to the mating connector.

DETAILED DESCRIPTION OF THE INVENTION

Figure 1:
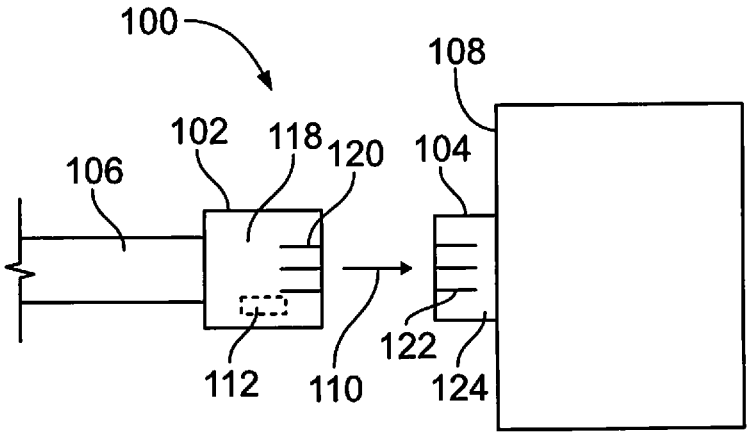
FIG. 1 is a schematic view of an electrical connector system according to an embodiment showing a first connector poised for mating to a second connector.

FIG. 1 is a schematic view of an electrical connector system 100 according to an embodiment including a first connector 102 and a second connector 104. The first connector 102 and second connectors 104 are configured to be directly mated together. In FIG. 1, the first and second connectors 102, 104 are shown un-mated, but poised for mating to one another. The first and second connectors 102, 104 are utilized to provide a conductive signal transmission path across an interface between the connectors 102, 104. In the illustrated embodiment, the first connector 102 is terminated to a cable, wire, or wire harness 106. The second connector 104 is terminated to an electrical device, such as a server, a computer, a printed circuit board (for example, a daughter card or motherboard), a microprocessor, a router, or the like. The second connector 104 optionally is a header connector that is mounted to a structure or case 108 of a mechanical or electrical device, such as a server box, a transmission, a power steering system, or the like. The first connector 102 is configured to be moved in a mating direction 110 to mate with the second connector 104. In an alternative embodiment, both connectors 102, 104 may be cable-mounted connectors or both connectors 102, 104 may be structure-mounted header connectors.

The first connector 102 includes a housing 118 and a plurality of conductors 120 held by the housing 118. The conductors 120 are electrically connected to wires in the cable 106. The conductors 120 are configured to engage and electrically connect to corresponding mating conductors 122 of the second connector 104 when the connectors 102, 104 are mated. The conductors 122 of the second connector 104 are held by a housing 124 of the second connector 104. Although the first and second connectors 102, 104 each include multiple conductors 120, 122, respectively, in FIG. 1, the connectors 102, 104 may include only one respective conductor 120, 122 in an alternative embodiment.

In an embodiment, the first and second connectors 102, 104 are configured to be mated to one another during a manufacturing or assembly process. It may be useful to record that the first and second connectors 102, 104 are mated, such as to track progress during the manufacturing or assembly process and for verification if a question or issue arises later regarding whether the first and second connectors 102, 104 were mated. In an exemplary embodiment, the first connector 102 includes a visual identifier 112. The visual identifier 112 is associated with the respective first connector 102. For example, the visual identifier 112 may identify the first connector 102, such as via a part number. The visual identifier 112 may also be associated with the second connector 104, such as by identifying the second connector 104 to which the first connector 102 is configured to mate or by identifying the broader electrical connector system 100. The visual identifier 112 further may be associated with a larger machine or apparatus in which the first connector 102 is a component thereof, such as a specific type or model of automobile or appliance. For example, the visual identifier 112 may provide a part number of the first connector 102 and a Vehicle Identification Number (VIN) number of the automobile into which the first connector 102 is being assembled. In an alternative embodiment, the visual identifier 112 may be disposed on the second connector 104 instead of, or in addition to the first connector 102.

In an exemplary embodiment, the first connector 102 is configured such that the visual identifier 112 is hidden or concealed when the first connector 102 is not mated to the second connector 104, and the visual identifier 112 is exposed or at least exposable when the first and second connectors 102, 104 are mated together. As used herein, "exposable" means that the item is able to be exposed by a routine operation without requiring undue force that may damage one or more components. In the illustrated embodiment, the visual identifier 112 is depicted in phantom to indicate that the visual identifier 112 is concealed. The first connector 102 therefore is able to switch between a concealed state, in which the visual identifier 112 is concealed, and an exposed state, in which the visual identifier 112 is exposed. In the concealed state, the visual identifier 112 is not able to be viewed and read by a sensor 114 (shown in FIG. 2). Thus, the information on the visual identifier 112 is not able to be read and recorded when the connectors 102, 104 are not mated. This mechanism prevents falsely logging that the connectors 102, 104 are mated when the connectors 102, 104 are not, in fact, actually mated. The visual identifier 112 is only viewable for logging that the connectors 102, 104 have been mated when the connectors 102, 104 are actually mated. Thus, the connector system 100 provides recordable position assurance that the first and second connectors 102, 104 are mated to one another.

Figure 2:
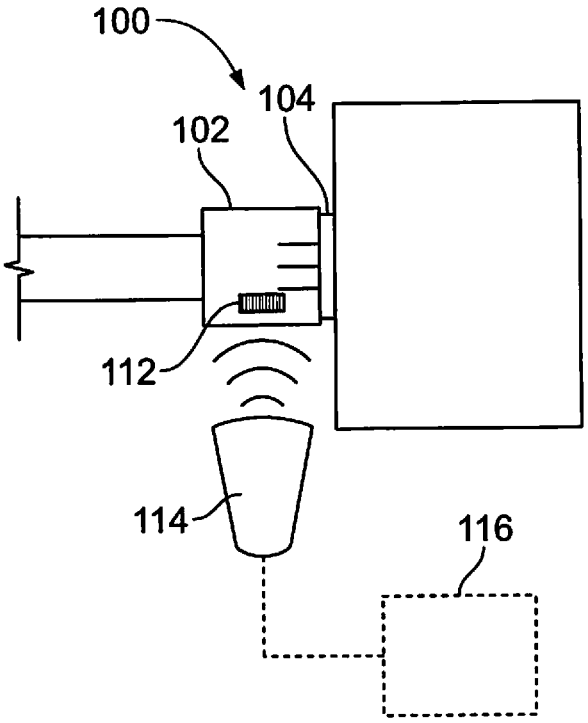
FIG. 2 is a schematic view of the electrical connector system showing a first connector mated to a second connector.

FIG. 2 is a schematic view of the electrical connector system 100 of FIG. 1 showing the first connector 102 mated to the second connector 104. Since the first and second connectors 102, 104 are mated, the visual identifier 112 is revealed or exposed. The visual identifier 112 shown in FIG. 2 is a one-dimensional barcode that includes a series of parallel lines, in other embodiments, the barcode label 112 may be a two-dimensional or matrix barcode or a three-dimensional barcode that includes a depth component. In other embodiments, the visual identifier 112 is other than a barcode, such as letters, shapes, colors, symbols, or the like. Although the visual identifier 112 is not limited to barcodes, the visual identifier 112 in some embodiments is a barcode, and the visual identifier 112 is referred to herein as a barcode label 112.

The barcode label 112 is able to be viewed and read by a sensor 114. The sensor 114 may be a handheld or mounted barcode scanner. The sensor 114 may include a light source and a photodetector to read the barcode label 112. Optionally, the sensor 114 may include a camera. The sensor 114 is communicatively coupled to a database 116 such that data obtained by the sensor 114 is transmitted to the database 116 for storage. The database 116 may be located on a tangible and non-transitory computer readable storage device. The storage device may be a computer memory, such as a Random Access Memory (RAM) or a hard disk drive, or the storage device may be a removable storage drive, such as a solid state device, an optical drive, an external hard drive, a flash drive, or the like. The database 116 may be accessible remotely from the sensor 114 and at subsequent times in order to access information about the connector system 100 and/or the automobile, appliance, or other machine or device into which the connector system 100 is installed. For example, by recording the information contained in the barcode label 112 in the database 116, the database 116 may be accessed remotely and/or at a subsequent date and time to verify that the first connector 102 has been mated to the second connector 104.

In one or more embodiments, the first connector 102 includes an indicating feature and a concealing feature. The barcode label 112 is disposed on the indicating feature. The indicating feature and the concealing feature are movable relative to each other. For example, the indicating feature may be configured to move while the concealing feature is stationary, the concealing feature may be configured to move while the indicating feature is stationary, or both features may be configured to move in different directions. The indicating feature and the concealing feature are movable between a concealed position and an exposed position. The concealing feature conceals at least a portion of the indicating feature that includes the barcode label 112 in the concealed position. For example, the entire barcode label 112 or a portion of the barcode label 112 is covered or obscured by the concealing feature in the concealed position. In some types of barcodes, such as two-dimensional barcodes, covering up half or even less than half of the barcode may prohibit a reader from being able to interpret any or some of the information contained in the barcode.

The portion of the indicating feature that includes the barcode label 112 is at least one of exposed or exposable in the exposed position such that the barcode label 112 is viewable and readable by the sensor 114. In the exposed position, all of the information contained in the barcode label 112 may be readable by the sensor 114. In an embodiment, the indicating feature is in the exposed position relative to the concealing feature only when the housing 118 is fully mated to the second connector 104. When the housing 118 is not fully mated to the second connector 104, the indicating feature is in the concealed position relative to the concealing feature. In an alternative embodiment, the indicating feature is in the exposed position relative to the concealing position when the housing 118 is not fully mated to the second connector 104, and the indicating feature is concealed or concealable only when the housing 118 is fully mated to the second connector 104. In such alternative embodiment, the lack of the barcode label 112 being viewable and readable by the sensor 114 indicates that the connectors 102, 104 are fully mated.

The indicating feature and the concealing feature are both carried by the housing 118. As used herein, a respective feature being "carried by the housing" means that the feature is either an integral component of the housing 118; disposed on, in, or through the housing 118; or coupled directly or indirectly to the housing 118, such that movement of the housing 118 moves the "carried" features as well. For example, a feature that is coupled indirectly to the housing 118 via a rotatable lever is carried by the housing as used herein.

Figure 3:
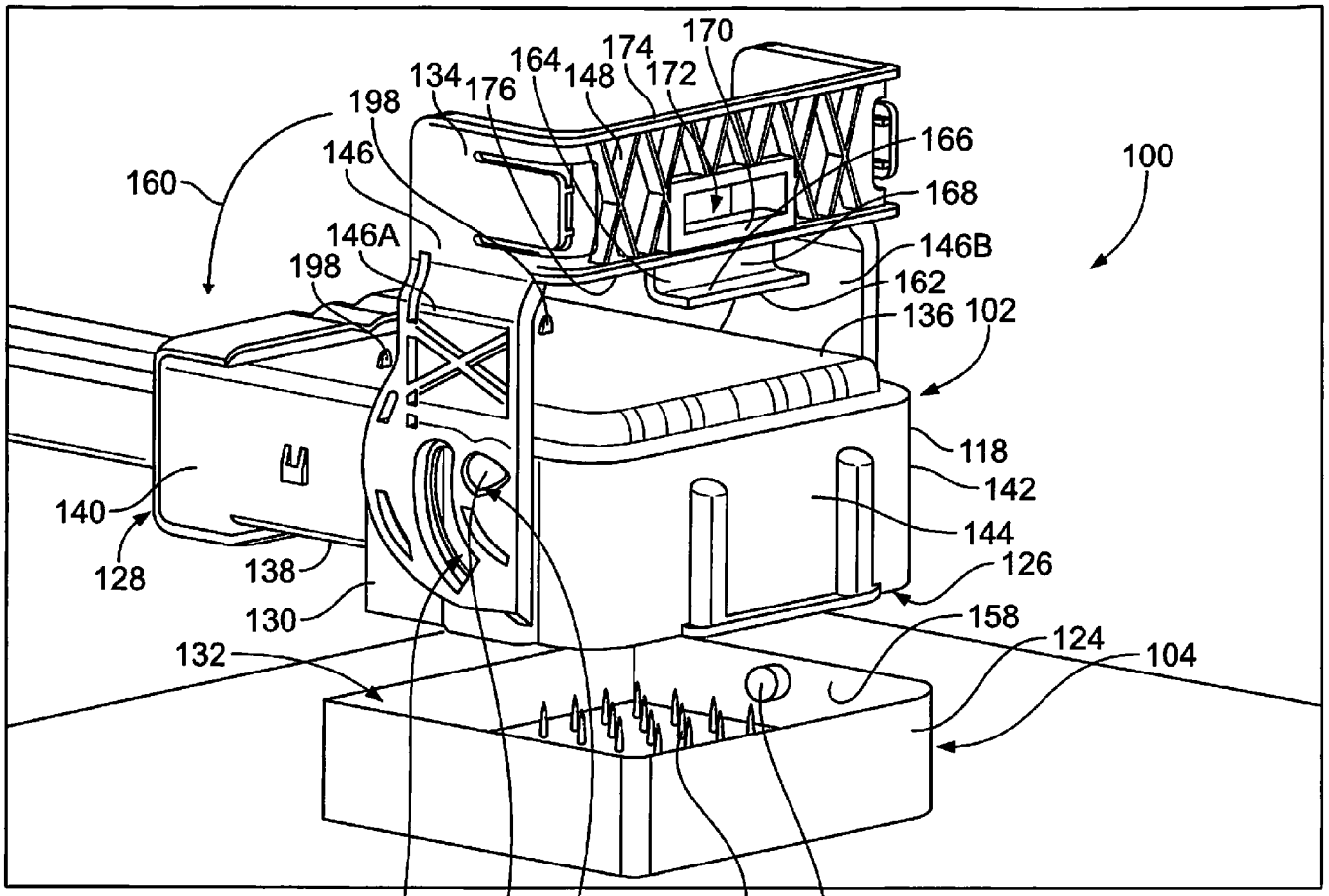
FIG. 3 is a side perspective view of the electrical connector system according to an embodiment.

FIG. 3 is a side perspective view of the electrical connector system 100 according to an embodiment. In the illustrated embodiment, the first connector 102 is poised for mating to the second connector 104. The first connector 102 includes a barcode label 112 (shown in FIG. 4), but the barcode label 112 is not visible in FIG. 3 because the barcode label 112 is concealed. The barcode label 112 is concealed due to the fact that the first and second connectors 102, 104 are not mated in the illustrated embodiment. The barcode label 112 is exposed in FIG. 4, which shows the first connector 102 in a mated position. For example, as described in more detail herein, the barcode label 112 is concealed by a concealing feature of the first connector 102 when the first connector 102 is not mated to the second connector 104. However, the barcode label 112 is exposed or at least exposable relative to the concealing feature when the first connector 102 is fully mated relative to the second connector 104. As used herein, exposable means able to be exposed or revealed via application of reasonable effort using an ordinary actuation mechanism. The barcode label 112 is exposed when it is able to be read by the sensor 114 (shown in FIG. 2).

The housing 118 of the first connector 102 includes a mating end 126 and a terminating end 128. In the illustrated embodiment, the mating end 126 is oriented along a plane that is transverse to a plane along which the terminating end 128 is oriented. For example, the first connector 102 may be a right angle connector such that the mating end 126 is perpendicular to the terminating end 128. In an alternative embodiment, the first connector 102 may be an inline connector such that the mating end 126 is parallel to and generally in-line with the terminating end 128. The electrical conductors 120 (shown in FIG. 1) are held within the housing 118. The housing 118 defines a mating interface 130 that is configured to engage the second connector 104 (or another complementary mating connector) during a mating operation. For example, the mating interface 130 is configured to engage the housing 124 of the second connector 104. In an embodiment, the mating interface 130 is configured to be received at least partially within an interior chamber 132 of the housing 124. Alternatively, the mating interface 130 may define an interior chamber that is configured to receive at least a portion of the housing 124 of the second connector 104 therein during the mating operation.

The housing 118 in an embodiment includes a top wall 136, a bottom wall 138, a left side wall 140, a right side wall 142, and a front end wall 144. As used herein, relative or spatial terms such as "top," "bottom," "front," "rear," "left," and "right" are only used to distinguish the referenced elements and do not necessarily require particular positions or orientations in the first electrical connector 102, the electrical connector system 100, or in the surrounding environment of the electrical connector system 100. The mating interface 130 extends from the bottom wall 138 and is at least partially defined by the left and right side walls 140, 142 and the front end wall 144.

In an embodiment, the housing 118 includes a lever 134. The lever 134 is movable coupled to the housing 118. For example, the lever 134 may be configured to rotate, pivot, or slide relative to the housing 118. The lever 134 is configured to provide a mating assist that reduces an amount of force required to mate the first and second connectors 102, 104. The lever 134 is movable relative to the housing 118 between an open position and a closed position. For example, the lever 134 is configured to engage the second connector 104 and pull the respective housings 118, 124 of the first and second connectors 102, 104 towards one another as the lever 134 is moved from the open position to the closed position. The lever 134 is configured such that the first connector 102 is fully mated to the second connector 104 when the lever 134 is in the closed position, and the first connector 102 is not fully mated to the second connector 104 when the lever 134 is not in the closed position. The lever 134 is not in the closed position when the lever 134 is in the open position or in an intermediate position between the open and closed positions. The lever 134 is in the open position in FIG. 3, and is in the closed position in FIG. 4.

In the illustrated embodiments shown in FIGS. 3-7, the lever 134 is configured to be rotated or pivoted in a curved locking direction 160 from the open position to the closed position to provide the mating assist. In an alternative embodiment that is not shown, the lever 134 may be slidable relative to the housing 118 from the open position to the closed position. For example, the lever 134 may include a wedge that pulls the respective housings 118, 124 of the first and second connectors 102, 104 towards one another as the lever 134 is advanced in a linear locking direction (not shown). Thus, the term "lever" as used herein is inclusive of features that move via sliding movements and is not limited to features that move via rotation and/or pivoting movements.

The lever 134 in FIG. 3 has a generally U-shaped structure that includes two arms 146 and a handle 148 that extends between and connects the two arms 146. The arms 146 are pivotally coupled to the left and right side walls 140, 142 such that a first arm 146A is coupled to the left side wall 140 and a second arm 146B is coupled to the right side wall 142. The arms 146 each define a pivot aperture 152 that receives a corresponding pivot element 154, referred to herein as post 154, of the housing 118 therein. The posts 154 extend from the left and right side walls 140, 142, although only the post 154 on the left side wall 140 is visible in FIG. 3. The lever 134 couples to the housing 118 via the engagement between the posts 154 and the edges of the arms 146 that define and surround the pivot apertures 152. The posts 154 are fixed axles, and the arms 146 of the lever 134 to pivot about the posts 154. Alternatively, the posts 154 may be rotatable relative to the housing 118. In an alternative embodiment, the lever 134 includes integral posts that function as axles and are received within holes in the housing 118.

The arms 146 each define a curved track 150 that is proximate to the aperture 152. The curved track 150 is configured to engage a component of the housing 124 of the second connector 104. For example, the housing 124 may include at least two projections 156, referred to herein as rods 156, that extend at least partially into the interior chamber 132 from inner surfaces 158 of the housing 124. The rods 156 are configured to be received in the corresponding curved tracks 150 of the arms 146 during the mating operation. Rotating or pivoting the lever 134 about the posts 154 causes the curved tracks 150 to move relative to the rods 156. As the lever 134 is shifted or pivoted from the open position to the closed position, the edges of the curved tracks 150 engage the rods 156 and pull the rods 156 in a linear direction towards the posts 154. When the lever 134 reaches the closed position, the first connector 102 is fully mated relative to the second connector 104 such that the conductors 120 (shown in FIG. 1) of the first connector 102 are fully engaged with the corresponding conductors 122 of the second connector 104. In some alternative embodiments, the arms 146 of the lever 134 may include hooks instead of curved tracks to engage the rods 156, and/or the lever 134 may include projections that are received within grooves or curved tracks of the housing 124.

In the illustrated embodiment, the first connector 102 further includes a connector position assurance (CPA) element 162 that is configured to provide assurance that the first connector 102 is fully mated to the second connector 104 during a mating operation. For example, the CPA element 162 is movable between a first position and a second position. The CPA element 162 is disposed in the first position when the first connector 102 is not fully mated to the second connector 104, and the CPA element 162 is restricted from moving to the second position until the first connector 102 is fully mated to the second connector 104. The CPA element 162 may be configured to move to the second position automatically upon the connectors 102, 104 being fully mated due to a mechanical mechanism. Alternatively, fully mating the connectors 102, 104 does not move the CPA element 162 but allows the CPA element 162 to be movable to the second position by removing a mechanical impediment that restricts movement to the second position.

The CPA element 162 is coupled to the handle 148 of the lever 134 in the illustrated embodiment. Although not shown in FIG. 3, the barcode label 112 (shown in FIG. 4) is disposed on the CPA element 162. For example, the CPA element 162 includes a base portion 164 and a ledge portion 166 that extends from the base portion 164 and is bent out of plane of the base portion 164. The barcode label 112 is disposed on a first side 168 of the base portion 164 that faces the handle 148. Since the barcode label 112 is disposed on the CPA element 162, the CPA element 162 defines the indicating feature of the first connector 102 in the illustrated embodiment. In the illustrated embodiment, the CPA element 162 is in the first position. The barcode label 112 is concealed by a segment 170 of the handle 148 when the CPA element 162 is in the first position. Therefore, the handle 148 of the lever 134 defines the concealing feature of the first connector 102. The first position of the CPA element 162 may be referred to as a concealed position. Optionally, the handle 148 defines a window 172 that extends through the handle 148. The window 172 is located between a first end 174 and a second end 176 of the handle 148, such that the window 172 is interior of a perimeter of the handle 148.

Figure 4:
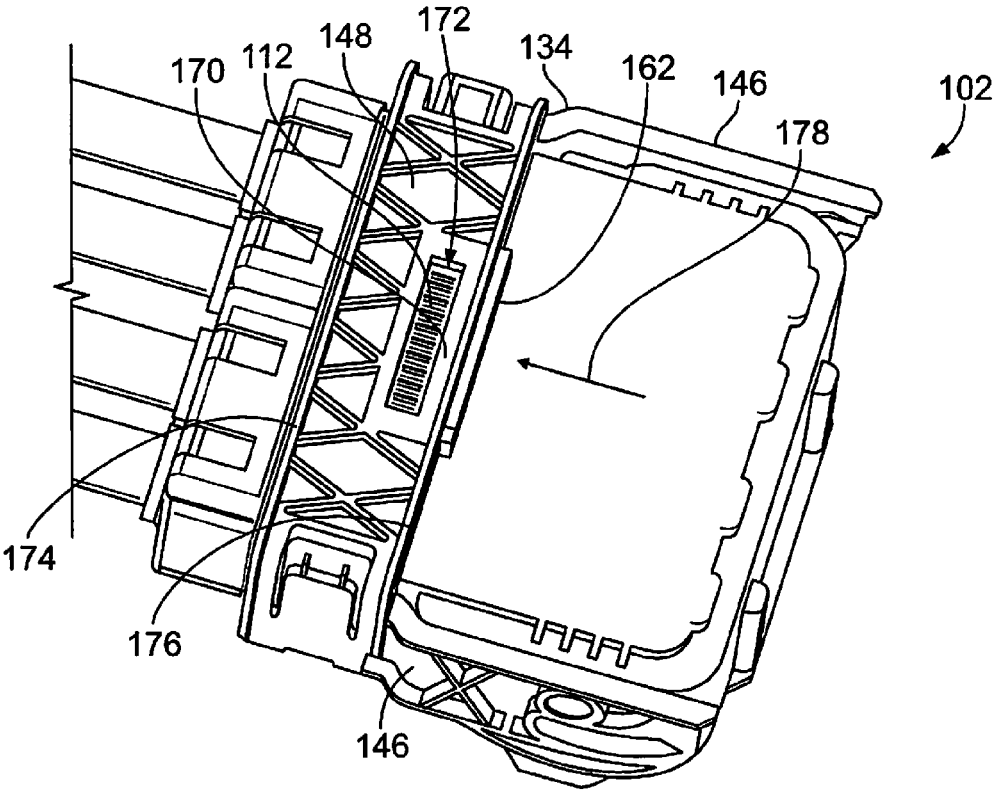
FIG. 4 is a top perspective view of the first connector according to the embodiment shown in FIG. 3 with a lever in the closed position.

FIG. 4 is a top perspective view of the first connector 102 according to the embodiment shown in FIG. 3 with the lever 134 in the closed position. The second connector 104 (shown in FIG. 3) is not shown in FIG. 3, although it is recognized that the lever 134 in the closed position indicates that the first connector 102 is fully mated to the second connector 104. Therefore, it is assumed in the following description of FIG. 4 that the first and second connectors 102, 104 are fully mated to one another.

The CPA element 162 is shown in the second position. In the second position, the barcode label 112 is exposed relative to the concealing feature (for example, the segment 170 of the handle 148). Therefore, the second position of the CPA element 162 may be referred to herein as an exposed position. In order to transition from the concealed position to the exposed position, the CPA element 162 is moved in a revealing direction 178 that extends generally from the second end 176 of the handle 148 towards the first end 174. In an embodiment, the CPA element 162 is restricted from being moved in the revealing direction 178 to the exposed position until the lever 134 is in the closed position, indicating that the first connector 102 is fully mated. An example mechanism that restricts movement of the CPA element 162 until the lever 134 is in the closed position is shown in FIG. 5.

Figure 5:
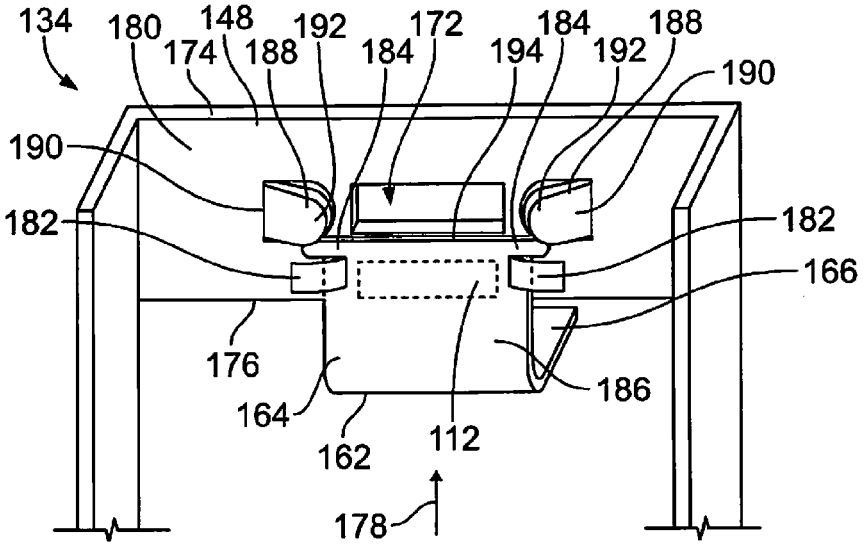
FIG. 5 is a rear perspective view of the lever of the first connector according to an embodiment.

FIG. 5 is a rear perspective view of the lever 134 of the first connector 102 according to an embodiment. The lever 134 is shown in the open position, and the CPA element 162 is shown in the concealed position. The CPA element 162 is coupled to a rear side 180 of the handle 148. The barcode label 112 is shown in phantom because it is disposed on the first or front side 168 (shown in FIG. 3) of the CPA element 162. The barcode label 112 does not align with the window 172 of the handle 148 when the CPA element 162 is in the concealed position as shown. The barcode label 112 is disposed between the window 172 and the second end 176 of the handle 148. The CPA element 162 is configured to be moved in the revealing direction 178 towards the first end 174 of the handle 148 in order for the barcode label 112 to align with the window 172.

The CPA element 162 may be held between two lugs 182 or rails that project from the rear side 180. The lugs 182 may extend partially around a second or rear side 186 of the CPA element 162 to hold the CPA element 162 in abutment with, or at least proximate to, the rear side 180 of the handle 148. The base portion 164 may include laterally-extending fingers 184 that engage the lugs 182 to prevent the CPA element 162 from falling off of the handle 148. The handle 148 defines two deflectable tabs 188 that are biased to extend at least partially rearward from the rear side 180 of the handle 148. For example, the tabs 188 may be cantilevered with a fixed end 190 that is directly attached to the handle 148 and a free end 192 that is indirectly attached to the handle 148 via the fixed end 190. In an embodiment, the tabs 188 in a resting, undeflected state are configured to block the movement path of the CPA element 162 to restrict movement from the concealed position to the exposed position. For example, the free ends 192 of the tabs 188 may engage a top edge 194 of the CPA element 162, such as along the fingers 184 of the CPA element 162.

Referring now back to FIG. 3, the housing 118 of the first connector 102 in an embodiment defines two protrusions 198 that project from the top wall 136 of the housing 118. The protrusions 198 are located such that as the lever 134 is moved to the closed position, each protrusion 198 engages a corresponding one of the deflectable tabs 188. Referring now back to FIG. 5, the protrusions 198 force the tabs 188 to deflect towards the surface of the rear side 180 of the handle 148, and optionally beyond the surface of the rear side 180, which moves the tabs 188 out of the movement path of the CPA element 162. Therefore, when the lever 134 is in the closed position, the tabs 188, which normally impede movement of the CPA element 162 in the revealing direction 178, are deflected out of the path of the CPA element 162 by the protrusions 198 such that the CPA element 162 is able to be moved to the exposed position. The CPA element 162 may be configured to be moved by an operator pushing or pulling the ledge portion 166 in the revealing direction 178. Although the illustrated embodiment shows two tabs 188 and two corresponding protrusions 198 on the housing 118, alternative embodiments may include only one tab 188 and one protrusion 198 or more than two tabs 188 and protrusions 198. In describing the mechanism shown in FIG. 5, it is recognized that the inventive subject matter described herein is not limited to this one example mechanism. Other mechanisms may be used for prohibiting movement of the CPA element 162 until the lever 134 is in the closed position.

Referring now back to FIG. 4, when the CPA element 162 is in the exposed position, the barcode label 112 aligns with and is exposed through the window 172 of the handle 148. The barcode label 112 is able to be viewed and read by the sensor 114 (shown in FIG. 2) through the window. The barcode label 112 in the illustrated embodiment is a one-dimensional barcode that includes a series of parallel lines with spaces therebetween. The number, width, and arrangement of the lines and spaces convey specific information. The information may identify the first connector 102 and/or the connector system 100 (shown in FIG. 3), such as by providing a part number, a manufacturer, a part name, or the like. The information also may identify an automobile, appliance, or another machine or device into which the connector system 100 is installed. The barcode label 112 may be printed, painted, etched, or otherwise formed directly on the CPA element 162. Alternatively, the barcode label 112 may be formed on a sticker, film, or the like, and subsequently bonded or otherwise attached to the CPA element 162. In other embodiments, the barcode may be a two-dimensional matrix style barcode or a three-dimensional barcode instead of a one-dimensional barcode.

In an alternative embodiment, when the CPA element 162 is in the exposed position, the barcode label 112 is disposed outside of a perimeter of the handle 148 instead of being exposed through a window in the handle 148. For example, the CPA element 162 may be sized and/or shaped such that the top edge 194 (shown in FIG. 5) projects beyond the first end 174 of the handle 148 when in the exposed position, and the barcode label 112 is exposed outside of (or exterior to) the first end 174. In another alternative embodiment, the CPA element 162 may be coupled to one of the arms 146 of the lever 134 instead of the handle 148.

Figure 6:
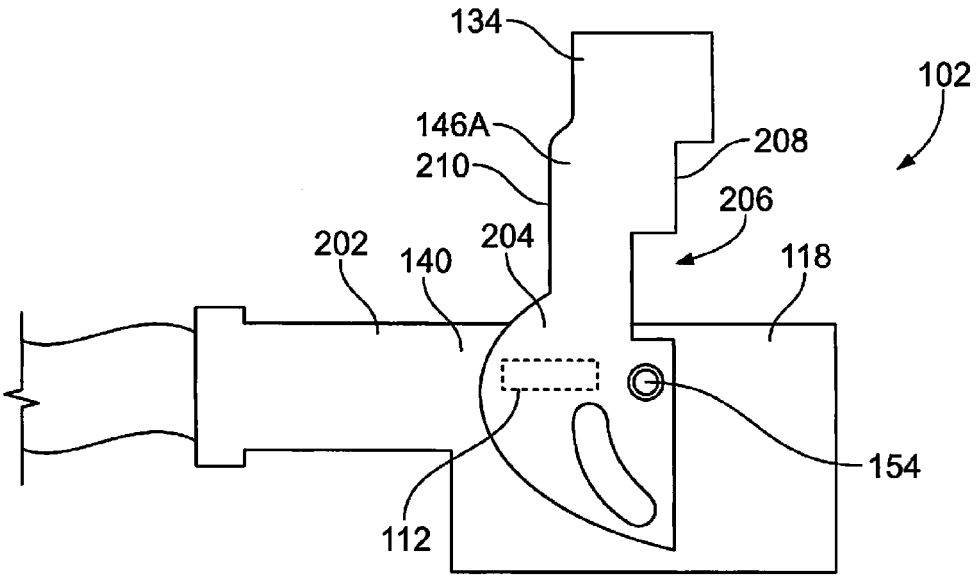
FIG. 6 is a side view of the first connector of the electrical connector system according to another embodiment.

FIG. 6 is a side view of the first connector 102 of the connector system 100 (shown in FIG. 1) according to another embodiment. The lever 134 is pivotally coupled to the housing 118 at the pivot element 154 or post. The lever 134 is in the open position relative to the housing 118 in FIG. 6. The barcode label 112 is disposed on an outer surface 202 of the housing 118, such that a wall of the housing 118 defines the indicating feature in the illustrated embodiment. The barcode label 112 is concealed by a segment 204 of the lever 134, which defines the concealing feature that conceals the barcode label 112 when the housing 118 is not fully mated to the mating connector (such as the second connector 104 shown in FIG. 3). The barcode label 112 is shown in phantom since it is concealed by the segment 204 of the lever 134. In the illustrated embodiment, the barcode label 112 is disposed on the outer surface 202 of the left side wall 140 of the housing 118, and the segment 204 is the first arm 146A of the lever 134 that is disposed along the left side wall 140.

The arm 146A defines a recessed portion 206 along a first edge 208 of the arm 146A. The recessed portion 206 is an indentation or cutout section in the arm 146A that extends from the first edge 208 towards, but not fully to, a second edge 210 of the arm 146A. The recessed portion 206 is similar to the window 172 shown in FIG. 3, except that the recessed portion 206 is undefined along one side at the first edge 208.

Figure 7:
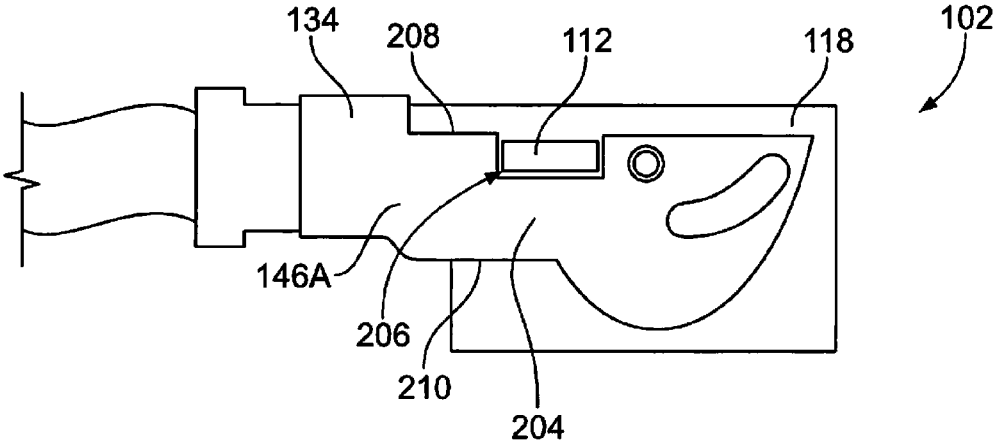
FIG. 7 is a side view of the first connector according to the embodiment shown in FIG. 6, showing the lever in the closed position relative to the housing.

FIG. 7 is a side view of the first connector 102 according to the embodiment shown in FIG. 6, showing the lever 134 in the closed position relative to the housing 118. As shown in FIG. 7, when the lever 134 is pivoted to the closed position, the recessed portion 206 of the lever 134 aligns with the barcode label 112 on the housing 118 such that the barcode label 112 is exposed and viewable through the recessed portion 206. Therefore, the barcode label 112 is exposed relative to the first arm 146A, which formerly concealed the barcode label 112. The recessed portion 206 has a size and shape that corresponds to the size and shape of the barcode label 112 in order to expose the full area of the barcode label 112. Although the barcode label 112 is rectangular in the illustrated embodiment, the barcode label 112 may be square-shaped, round, elliptical, or the like in other embodiments.

In alternative embodiments, the recessed portion 206 may be defined along the second edge 210 of the arm 146A instead of along the first edge 208, or the arm 146A may define a window similar to the window 172 shown in FIG. 3 instead of a recessed portion along one of the edges 208, 210. Furthermore, a second barcode label may be disposed on the right side wall 142 (shown in FIG. 3) of the housing 118 instead of, or in addition to, the first barcode label 112 shown in FIGS. 6 and 7 on the left side wall 140, such that the second arm 146B (FIG. 3) of the lever 134 conceals the second barcode label until the lever 134 is in the closed position.

In another alternative embodiment, the barcode label 112 is disposed on an inner surface (not shown) of the lever 134, such that an arm of the lever 134 defines the indicating feature, instead of the barcode label 112 being located on the housing 118 as shown in FIGS. 6 and 7. The housing 118 defines the concealing feature. For example, the barcode label 112 may be disposed on a tab or portion of the lever 134 that aligns with and faces a side of the housing 118 when the lever 134 is in the open position. When the lever 134 is pivoted to the closed position, however, the tab or portion of the lever 134 with the barcode label 112 thereon projects beyond the side of the housing 118 (for example, vertically or laterally) to expose the barcode label 112 for reading the barcode label 112.

Figure 8:
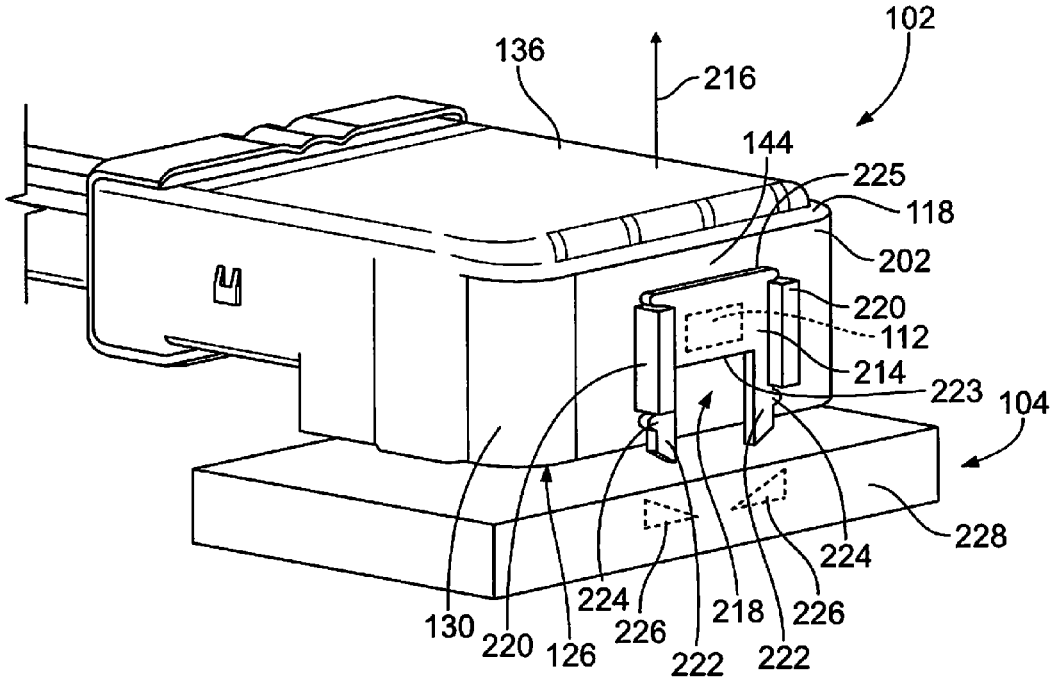
FIG. 8 is a perspective view of the first connector of the connector system according to another embodiment.

FIG. 8 is a perspective view of the first connector 102 of the connector system 100 (shown in FIG. 1) according to another embodiment. The housing 118 of the first connector 102 optionally does not include a lever to provide a mating assist. In the illustrated embodiment, the barcode label 112 is disposed on an outer surface 202 of the housing 118. For example, the barcode label 112 may be located on the front end wall 144, such that the front end wall 144 of the housing 118 defines the indicating feature. The housing 118 further includes a CPA element 214 that is coupled to the outer surface 202. The CPA element 214 extends over the barcode label 112 to define the concealing feature that conceals the barcode label 112 when the housing 118 is not fully mated to the mating connector (for example, the second connector 104). In the illustrated embodiment, as the mating interface 130 engages the second connector 104, the CPA element 214 is configured to engage the second connector 104 and to slide relative to the housing 118 in a revealing direction 216 to expose the barcode label 112 when the housing 118 is fully mated to the second connector 104. Thus, the CPA element 214 provides position assurance because the CPA element 214 only slides relative to the housing 118 when the housing 118 is fully mated to the second connector 104. The CPA element 214 is referred to below as a slidable insert 214. The revealing direction 216 extends away from the mating end 126 of the housing 118 towards the top wall 136.

In an embodiment, the slidable insert 214 is a planar panel that is held in a track 218 between two rails 220 of the housing 118 that extend along the outer surface 202. The slidable insert 214 is in a concealed position in FIG. 8, such that the slidable insert 214 extends over the barcode label 112 to block the barcode label 112 from being read by the sensor 114 (shown in FIG. 2). The slidable insert 214 includes at least one deflectable latch 222 extending from a first end 223 of the insert 214. The first end 223 of the insert 214 is more proximate to the mating end 126 of the housing 118 than a second end 225 of the insert 214. The insert 214 includes two latches 222 in the illustrated embodiment. The latches 222 each include a catch 224 that projects from the respective latch 222. The catch 224 is configured to engage a corresponding one of the rails 220 of the housing 118 to prohibit the slidable insert 214 from being moved in the revealing direction 216 along the track 218 when the housing 118 is not fully mated to the second connector 104.

The housing 124 of the second connector 104 in an embodiment includes at least one lug 226 that projects from a corresponding wall 228 of the housing 124 that abuts or at least faces the slidable insert 214. In the illustrated embodiment, two lugs 226 are shown in phantom as the lugs 226 are located on an inner surface of the wall 228 that is not visible.

Figure 9:
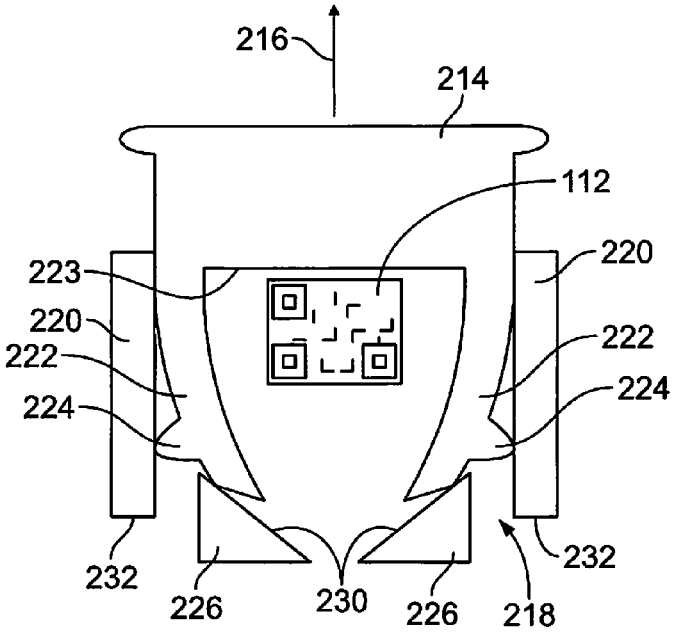
FIG. 9 illustrates a connector position assurance (CPA) element and rails of the first connector as well as lugs of the second connector when the first connector is fully mated to the second connector.

FIG. 9 illustrates the CPA element 214 (or slidable insert 214) and the rails 220 of the first connector 102 (shown in FIG. 8) as well as the lugs 226 of the second connector 104 (FIG. 8) when the first connector 102 is fully mated to the second connector 104. As shown in FIG. 9, the lugs 226 have a tapered or angled upper edge 230 that forces and deflects the latches 222 toward one another and away from the corresponding rails 220. The deflection of the latches 222 releases the catches 224 from engagement with a bottom end 232 of the rails 220. The relative movement of the first and second connectors 102, 104 during the mating operation moves the lugs 226 vertically upward relative to the rails 220. The lugs 226 force the slidable insert 214 to move upwards along the track 218 with the lugs 226 in the revealing direction 216. Eventually, such movement of the slidable insert 214 exposes the barcode label 112. The barcode label 112 in the illustrated embodiment is exposed below the first end 223 of the insert 214, but in an alternative embodiment may be exposed through a window of the insert 214. Thus, the barcode label 112 is automatically exposed upon fully mating the first and second connectors 102, 104, without requiring additional human intervention beyond mating the connectors 102, 104. The barcode label 112 is depicted as a two-dimensional matrix style barcode in FIG. 9.

Figure 10:
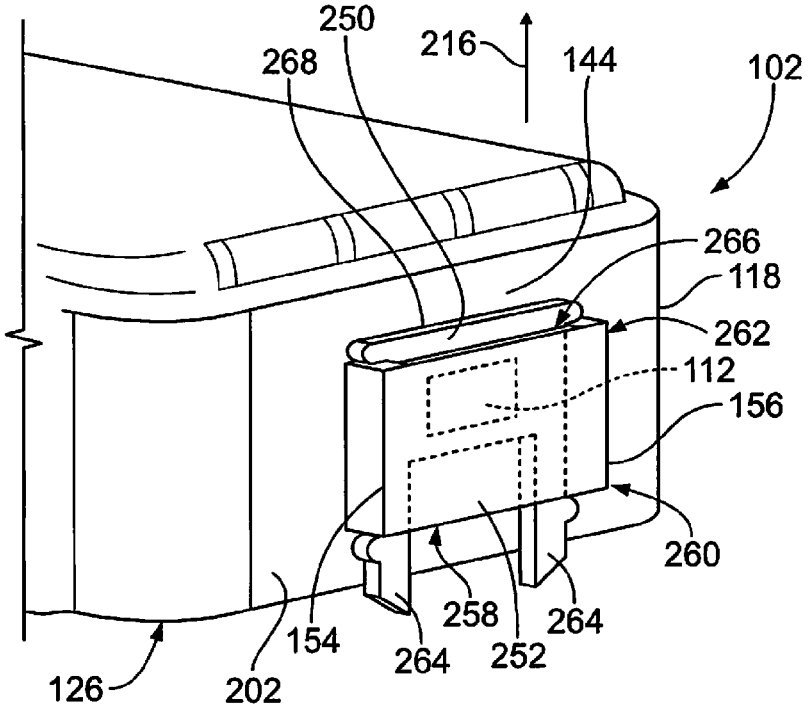
FIG. 10 is a perspective view of a portion of the first connector of the connector system according to yet another embodiment.

FIG. 10 is a perspective view of a portion of the first connector 102 of the connector system 100 (shown in FIG. 1) according to yet another embodiment. The portion of the first connector 102 that is shown includes the front end wall 144. Like the embodiment shown in FIGS. 8 and 9, the housing 118 of the first connector 102 includes a CPA element 250 that is coupled to the outer surface 202 of the front end wall 144 on or proximate to the mating interface 130. The CPA element 250 is referred to herein as slidable insert 250. In the illustrated embodiment, the barcode label 112 is disposed on the slidable insert 250 (not on the outer surface 202 of the housing 118), such that the slidable insert 250 is the indicating feature. The concealing feature that conceals the barcode label 112 when the first connector 102 is not fully mated to the mating connector is a receptacle 252 of the housing 118. The slidable insert 250 is held within the receptacle 252. The barcode label 112 and portions of the slidable insert 250 within the receptacle 252 are shown in phantom.

The receptacle 252 has opposite left and right sides 254, 256 secured to the outer surface 202 of the housing 118 and a first opening 258 at a first or lower end 260 of the receptacle 252. The left and right sides 254, 256 of the receptacle 252 optionally may be defined by the rails 220 shown in FIGS. 8 and 9. The lower end 260 of the receptacle 252 is more proximate to the mating end 126 of the housing 118 than a second or upper end 262 of the receptacle 252. The slidable insert 250 may have a similar shape to the slidable insert 214 shown in FIGS. 8 and 9. For example, the slidable insert 250 includes two latches 264 that protrude through the first opening 258 at the lower end 260 of the receptacle 252. The latches 264, like the latches 222 shown in FIGS. 8 and 9, are configured to prohibit movement of the slidable insert 250 from the concealed position to the exposed position until a fully mated connection is achieved. Lugs 226 (shown in FIG. 8) of the second connector 104 (FIG. 8) release the latches 264 and drive the slidable insert 250 in the revealing direction 216 to the exposed position.

In the illustrated embodiment, the receptacle 252 has a second opening 266 at the upper end 262 of the receptacle 252. Although not shown, when the receptacle 252 is in the exposed position, a top end 268 of the slidable insert 250 protrudes through the second opening 266 and the barcode label 112 on the insert 250 is exposed above the upper end 262 of the receptacle 252. In an alternative embodiment, the receptacle 252 may define a window, and the barcode label 112 is exposed through the window of the receptacle 252 when the slidable insert 250 is in the exposed position. In such an alternative embodiment, the upper end 262 of the receptacle 252 optionally may be closed (such that the receptacle 252 does not define the second opening 266).

Figure 11:
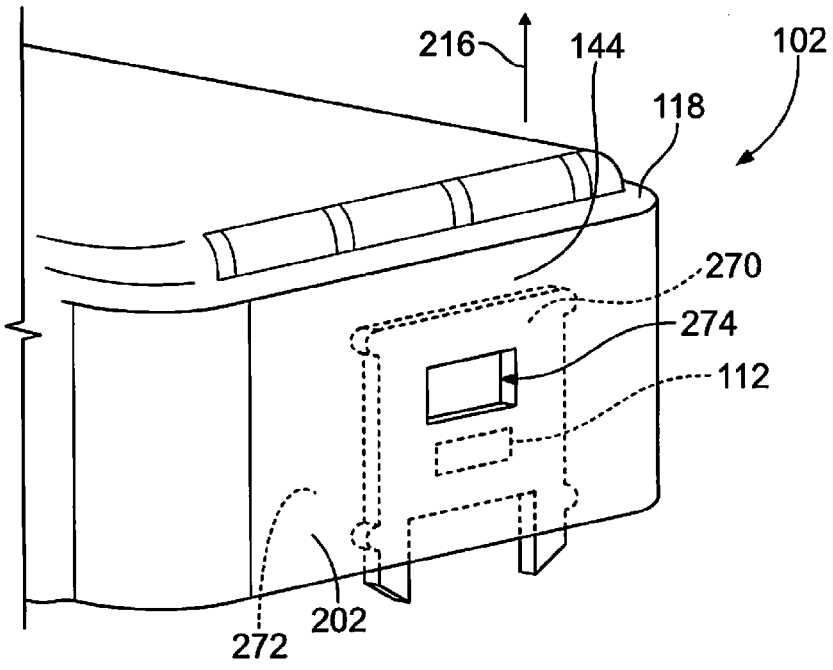
FIG. 11 is a perspective view of a portion of the first connector of the connector system formed in accordance with another embodiment.

FIG. 11 is a perspective view of a portion of the first connector 102 of the connector system 100 (shown in FIG. 1) formed in accordance with another embodiment. In the illustrated embodiment, the barcode label 112 is disposed on a CPA element 270 which defines the indicating feature, like the embodiment shown in FIG. 10. The CPA element 270, referred to herein as slidable insert 270, is coupled to and disposed along an inner surface 272 of the front end wall 144 of the housing 118. The front end wall 144 defines a window 274 that extends through the wall 144 between the inner surface 272 and the outer surface 202 thereof. The wall 144 defines the concealing feature that conceals the barcode label 112 when the slidable insert 270 is in the concealed position. The slidable insert 270 is in the concealed position relative to the housing 118 in FIG. 11. The barcode label 112 and most of the slidable insert 270 are shown in phantom since these components are located on the other side of the front end wall 144. Alternatively, another wall of the housing 118 may be used as the concealing feature instead of the front end wall 144.

The mechanism that releases the slidable insert 270 from the concealed position and moves the slidable insert 270 in the revealing direction 216 to the exposed position optionally may be similar to the embodiments shown and described in FIGS. 8-10. The barcode label 112 is disposed on an outward-facing surface of the slidable insert 270 such that when the slidable insert 270 is in the exposed position, the barcode label 112 aligns with the window 274 and is viewable from outside the housing 118 through the window 274. With additional reference to FIG. 3, the embodiment shown in FIG. 11 may be used, for example, when the housing 124 of the second connector 104 is received within an interior chamber of the housing 118 of the first connector 102 during the mating operation, instead of the housing 118 being received in the interior chamber 132 of the housing 124 as shown in FIG. 3.

Figure 12:
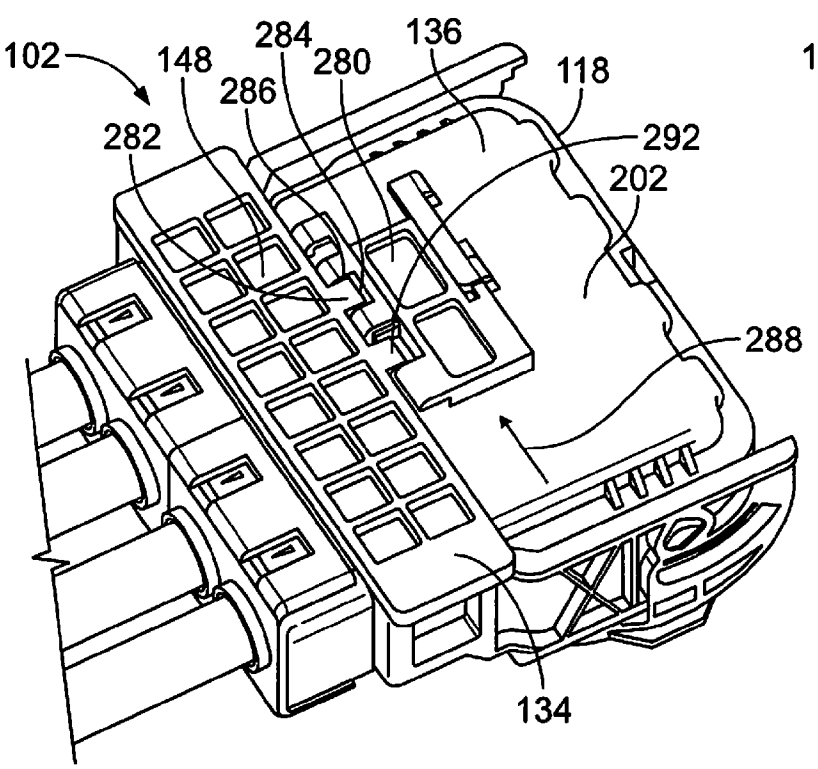
FIG. 12 is a top perspective view of the first connector according to another embodiment.

FIG. 12 is a top perspective view of the first connector 102 according to another embodiment. The first connector 102 includes a CPA element 280 that defines the concealing feature. The CPA element 280 is held on the top wall 136 of the housing 118 and is slidable relative to the housing 118. The barcode label 112 (shown in FIG. 13) is disposed on the outer surface 202 of the top wall 136, such that the top wall 136 of the housing 118 is the indicating feature. The barcode label 112 is concealed by the CPA element 280 in the illustrated position so the barcode label 112 is not viewable or machine-readable. Thus, the top wall 136 is in the concealed position relative to the CPA element 280 in FIG. 12.

The first connector 102 includes the lever 134 that provides a mating assist for mating the first connector 102 with the second connector 104 (shown in FIG. 3). The lever 134 is shown in the closed position. In an embodiment, the CPA element 280 is restricted from moving relative to the housing 118 when the lever 134 is not in the closed position. As the lever 134 is rotated to the closed position, a first tab 282 that projects from the handle 148 of the lever 134 engages a deflectable latch 284 of the CPA element 280, which releases the latch 284 from a catch surface 286 of the housing 118, allowing the CPA element 280 to slide in a revealing direction 288 relative to the housing 118 and the lever 134 thereon.

Figure 13:
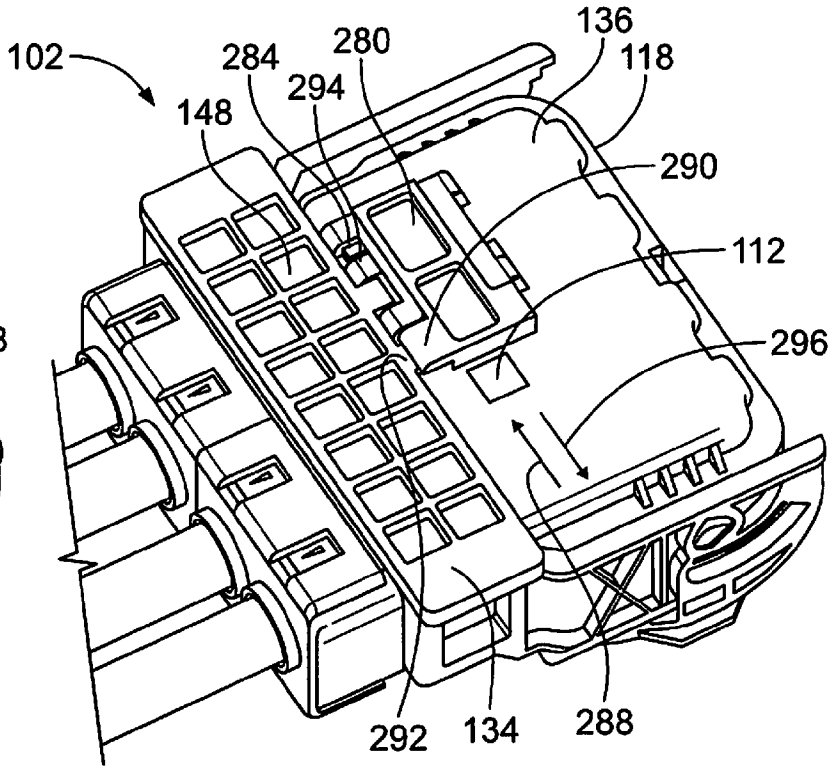
FIG. 13 is a top perspective view of the first connector according to the embodiment shown in FIG. 12.

FIG. 13 is a top perspective view of the first connector 102 shown in FIG. 12. In FIG. 13, the top wall 136 of the housing 118 is in the revealed position relative to the CPA element 280. For example, the CPA element 280 has been moved in the revealing direction 288 from the initial location shown in FIG. 12 to the final location shown in FIG. 13 to reveal the barcode label 112 that is disposed on the top wall 136. As the CPA element 280 moves in the revealing direction 288, a ledge 290 of CPA element 280 extends over a portion of the handle 148 of the lever 134 to mechanically block the lever 134 from rotating from the closed position towards the open position. For example, in the illustrated embodiment the ledge 290 extends over a second tab 292 (shown in more detail in FIG. 12) that projects from the handle 148. By extending over the handle 148, the CPA element 280 provides a lock that holds the lever 134 in the closed position. Optionally, the deflectable latch 284 (or a different latch) of the CPA element 280 may be configured to engage a second catch surface 294 of the housing 118 when the CPA element 280 is in the position shown in FIG. 13 to prohibit the CPA element 280 from inadvertently being moved relative to the housing 118 in a concealing direction 296 that is opposite the revealing direction 288.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. An electrical connector having recordable position assurance, the electrical connector comprising:

a housing having a mating interface configured to engage a complementary mating connector during a mating operation;

at least one electrical conductor held in the housing;

an indicating feature carried by the housing, the indicating feature having a visual identifier disposed thereon, the visual identifier comprising at least one of a one-dimensional barcode, a two-dimensional barcode, or a three-dimensional barcode; and a concealing feature carried by the housing, wherein the indicating feature and the concealing feature are movable relative to each other between a concealed position and an exposed position, the concealing feature concealing at least a portion of the visual identifier in the concealed position, the visual identifier being at least one of exposed or exposable in the exposed position;

wherein the indicating feature is in the concealed position relative to the concealing feature when the housing is not fully mated relative to the mating connector, and the indicating feature is in the exposed position relative to the concealing feature responsive to the housing being fully mated to the mating connector.

2. The electrical connector of claim 1, wherein the visual identifier identifies the electrical connector, the visual identifier being machine-readable such that the visual identifier is able to be read by a sensor when the visual identifier is exposed in the exposed position of the indicating feature relative to the concealing feature.

3. The electrical connector of claim 1, wherein the housing includes a lever that is movable relative to the housing between an open position and a closed position, the lever configured to engage the mating connector and move the housing and the mating connector relatively towards one another as the lever is moved from the open position to the closed position such that the housing is fully mated to the mating connector when the lever is in the closed position, the lever defining the concealing feature.

4. The electrical connector of claim 3, wherein a side wall of the housing defines the indicating feature, the visual identifier is disposed on an outer surface of the side wall, the side wall being pivotally coupled to an arm of the lever, the arm concealing the visual identifier when the lever is not in the closed position, the visual identifier being exposed at least one of through a window extending through the arm or outside of a perimeter of the arm when the lever is in the closed position.

5. The electrical connector of claim 3, wherein the indicating feature is a connector position assurance (CPA) element that the visual identifier is disposed thereon, the CPA element being coupled to the lever and movable relative to the lever, the visual identifier being concealed by a segment of the lever when the CPA element is in the concealed position relative to the lever, the visual identifier being exposable at least one of through a window defined in the segment or outside a perimeter of the segment when the CPA element is in the exposed position relative to the lever.

6. The electrical connector of claim 5, wherein the lever includes at least one tab that engages the CPA element to block movement of the CPA element from the concealed position to the exposed position relative to the lever when the lever is not in the closed position, the housing defining at least one protrusion that engages and deflects the at least one tab when the lever is in the closed position such that the CPA element is able to be moved to the exposed position relative to the lever.

7. The electrical connector of claim 1, wherein a wall of the housing defines the indicating feature, the visual identifier is disposed on an outer surface of the wall, the concealing feature being a connector position assurance (CPA) element that is coupled to and movable relative to the wall of the housing, the CPA element extending over and concealing the visual identifier when the CPA element is in the concealed position relative to the wall.

8. The electrical connector of claim 7, wherein the wall of the housing that defines the indicating feature is at least one of on or proximate to the mating interface, the CPA element being configured to engage the mating connector and to be moved by the mating connector in a revealing direction relative to the wall of the housing as the housing is being mated to the mating connector such that the CPA element is in the exposed position relative to the wall and the visual identifier is exposed when the housing is fully mated to the mating connector.

9. The electrical connector of claim 8, wherein the CPA element is held in a track between two rails on the wall of the housing, the CPA element including at least one deflectable latch extending from a first end of the CPA element, the at least one deflectable latch engaging at least one of the rails to restrict movement of the CPA element in the revealing direction to the exposed position when the housing is not fully mated to the mating connector, the at least one deflectable latch configured to be deflected by at least one corresponding lug of the mating connector as the housing is being mated to the mating connector to allow the CPA element to be moved relative to the rails to the exposed position.

10. The electrical connector of claim 1, wherein the indicating feature is a connector position assurance (CPA) element that is coupled to and movable relative to the housing, the CPA element being held within a receptacle of the housing, the receptacle defining the concealing feature such that the visual identifier on the CPA element is concealed by the receptacle when the CPA element is in the concealed position relative to the receptacle, wherein, as the housing engages the mating connector, the CPA element is configured to engage the mating connector and be moved by the mating connector in a revealing direction relative to the receptacle such that the CPA element is in the exposed position and the visual identifier is exposed when the housing is fully mated to the mating connector.

11. The electrical connector of claim 10, wherein the receptacle has opposite left and right sides secured to an outer surface of the housing, the receptacle defining a first opening at a first end of the receptacle, the CPA element including at least one deflectable latch protruding from the receptacle through the first opening, the at least one deflectable latch engaging at least one of the left and right sides of the receptacle to restrict movement of the CPA element in the revealing direction when the housing is not fully mated to the mating connector, the at least one deflectable latch configured to be deflected by at least one corresponding lug of the mating connector as the housing engages the mating connector to allow the CPA element to be moved by the mating connector to the exposed position relative to the receptacle of the housing.

12. The electrical connector of claim 10, wherein, when the housing is fully mated to the mating connector, the visual identifier on the CPA element is exposed at least one of through a window defined in the receptacle or beyond a second end of the receptacle through a second opening of the receptacle.

13. The electrical connector of claim 1, wherein the indicating feature is a connector position assurance (CPA) element that is coupled to and movable relative to the housing along an inner surface of a wall of the housing, the wall of the housing defining the concealing feature, the CPA element being configured to engage the mating connector as the housing is being mated to the mating connector which allows the CPA element to be moved in a revealing direction relative to the wall of the housing, the visual identifier on the CPA element being exposed through a window defined in the wall of the housing when the housing is fully mated to the mating connector.

14. An electrical connector having recordable position assurance, the electrical connector comprising:

a housing having a mating interface configured to engage a complementary mating connector during a mating operation;

at least one electrical conductor held in the housing;

a connector position assurance (CPA) element coupled to the housing, the CPA element movable relative to the housing between a first position and a second position, the CPA element disposed in the first position and restricted from moving to the second position when the electrical connector is not fully mated to the mating connector, the CPA element configured to be at least one of moved or movable from the first position to the second position responsive to the electrical connector being fully mated to the mating connector;

an indicating feature having a visual identifier disposed thereon, the visual identifier identifying the electrical connector; and a concealing feature that is configured to conceal at least a portion of the visual identifier in a concealed position, wherein the indicating feature and the concealing feature are movable relative to each other between the concealed position and an exposed position, the visual identifier being at least one of exposed or exposable in the exposed position;

wherein the indicating feature is in the concealed position relative to the concealing feature when the housing is not fully mated relative to the mating connector, and the indicating feature is in the exposed position relative to the concealing feature responsive to the housing being fully mated to the mating connector, wherein the CPA element defines at least one of the indicating feature or the concealing feature, the other of the indicating feature and the concealing feature being defined by one of a wall of the housing or a lever coupled to the housing.

15. The electrical connector of claim 14, wherein the visual identifier is one of a one-dimensional barcode, a two-dimensional barcode, or a three-dimensional barcode.

16. The electrical connector of claim 14, wherein the lever coupled to the housing defines the concealing feature, the lever being movable relative to the housing between an open position and a closed position, the lever configured to engage the mating connector and move the housing and the mating connector relatively towards one another as the lever is moved from the open position to the closed position such that the housing is fully mated to the mating connector when the lever is in the closed position.

17. The electrical connector of claim 16, wherein the CPA element defines the indicating feature that the visual identifier is disposed thereon, the CPA element being coupled to the lever and movable relative to the lever, the visual identifier being concealed by a segment of the lever when the CPA element is in the first position of the CPA element, the visual identifier being exposable at least one of through a window defined in the segment or outside a perimeter of the segment when the CPA element is in the second position, the lever including at least one deflectable tab that restricts movement of the CPA element from the first position to the second position when the lever is not in the closed position and allows movement of the CPA element from the first position to the second position when the lever is in the closed position.

18. The electrical connector of claim 14, wherein the wall of the housing defines the concealing feature and the CPA element defines the indicating feature on which the visual identifier is disposed, the CPA element being coupled to the housing along an inner surface of the wall, the CPA element being configured to engage the mating connector as the housing is being mated to the mating connector such that the CPA element is moved by the mating connector in a revealing direction relative to the housing from the first position to the second position to expose the visual identifier through a window defined in the wall of the housing when the housing is fully mated to the mating connector.

19. The electrical connector of claim 14, wherein the CPA element is configured to move linearly from the first position to the second position.

20. The electrical connector of claim 14, wherein the CPA element defines the concealing feature and the wall of the housing defines the indicating feature, the CPA element configured to engage the mating connector and to be moved by the mating connector in a linear revealing direction relative to the wall of the housing from the first position to the second position as the electrical connector is mated to the mating connector, wherein, when the electrical connector is fully mated to the mating connector, the CPA element is in the exposed position relative to the wall and the visual identifier is exposed.

* * * * *